US005445868A

United States Patent [19]

Harasawa et al.

[11] Patent Number: 5,445,868

[45] Date of Patent: Aug. 29, 1995

[54] RECORDING SHEET AND RECORD

[75] Inventors: Masako Harasawa; Katsutoshi Misuda; Toshiya Matsubara; Toshihiro Tanuma, all of Yokohama, Japan

[73] Assignee: Asahi Glass Company Ltd., Tokyo, Japan

[21] Appl. No.: 208,292

[22] Filed: Mar. 10, 1994

[30] Foreign Application Priority Data

Mar. 10, 1993 [JP] Japan ..... 5-076207
Mar. 31, 1993 [JP] Japan ..... 5-096965
Mar. 31, 1993 [JP] Japan ..... 5-096966

[51] Int. Cl.[6] ..... B41M 5/00

[52] U.S. Cl. ..... 428/206; 428/195; 428/323; 428/331

[58] Field of Search ..... 428/195, 207, 304.4, 428/329, 331, 206, 323

[56] References Cited

U.S. PATENT DOCUMENTS 4,562,448 12/1985 Watanabe et al. .
4,775,594 10/1988 Desjarlais .
4,879,166 11/1989 Misuda et al. ..... 428/195
5,104,730 4/1992 Misuda et al. ..... 428/304.4

FOREIGN PATENT DOCUMENTS 0410051 1/1991 European Pat. Off. .

*Primary Examiner*—Pamela R. Schwartz
*Attorney, Agent, or Firm*—Oblon, Spivak, McClelland, Maier & Neustadt

[57] ABSTRACT

A recording sheet comprising a substrate and a colorant absorbing layer made of a porous inorganic oxide, formed on the substrate, wherein said colorant absorbing layer contains an organic acid with the first acid dissociation exponent of at most 5, which has an aromatic nucleus or at least two carboxyl groups.

16 Claims, No Drawings

RECORDING SHEET AND RECORD

The present invention relates to a recording sheet and a record.

It has been common to form images by means of various printers of e.g. an ink jet system, an electrophotography system or a dye diffusion thermal transfer system. In such cases, with ordinary paper, no adequate ink absorption or image resolution can be obtained, and it is difficult to obtain a transparent sheet. Therefore, a recording sheet having an inorganic porous layer formed on a substrate has, for example, been proposed as in e.g. U.S. Pat. No. 5,104,730.

With such a recording sheet having a porous layer excellent in the ink absorption and in the fixing of colorants, it has been likely that during the storage, the porous layer absorbs also plasticizers for the resin and thus undergoes a color change. It is an object of the present invention to provide a recording sheet excellent in the ink absorption as well as in the fixing of colorants, which undergoes no color change even when stored for a long period of time.

The present invention provides a recording sheet comprising a substrate and a colorant absorbing layer made of a porous inorganic oxide, formed on the substrate, wherein said colorant absorbing layer contains an organic acid with the first acid dissociation exponent of at most 5, which has an aromatic nucleus or at least two carboxyl groups.

Here, the organic acid with the first acid dissociation exponent of at most 5 includes not only polybasic acids but also monobasic acids. In the present invention, such an organic acid is incorporated to the colorant absorbing layer, whereby a color change of the recording sheet can be prevented. If the first acid dissociation exponent exceeds 5, no adequate effects of the present invention tend to be obtained. The lower limit for the first acid dissociation exponent is not particularly limited, but is preferably at least 1, since the colorant is likely to be modified, if the acidity is strong. More preferably, the first acid dissociation exponent is within a range of from 2 to 4. In the case of a polybasic acid, the second or higher acid dissociation exponent is not particularly limited, but is preferably at most 7.

The above organic acid is further required to have an aromatic nucleus or at least two carboxyl groups. When this requirement is met, the bonding between the colorant absorbing layer and the organic acid will be firm, whereby the effects for preventing a color change will not substantially decrease.

Preferred as an organic acid having an aromatic nucleus, is an organic acid having a carboxyl group or a sulfonic group on the aromatic nucleus. As the aromatic nucleus, a benzene nucleus is preferred. Specifically, phthalic acid (o-dicarboxybenzene), isophthalic acid (m-dicarboxybenzene), terephthalic acid (p-dicarboxybenzene), benzoic acid, salicylic acid, benzenesulfonic acid or phenylacetic acid may, for example, be mentioned. The dicarboxylic acid may partially or entirely be in the form of an anhydride.

Among such organic acids having aromatic nuclei, phthalic acid, isophthalic acid, terephthalic acid, benzoic acid and phenylacetic acid are preferred, since they are highly effective for preventing a color change and they have excellent printing properties when used for printing by an ink jet printer. Particularly preferred is phthalic acid.

As the organic acid having an aromatic nucleus, it is permissible to have one or more additive aromatic substituents.

The polybasic carboxylic acid may not only be the above-mentioned aromatic polybasic carboxylic acid such as phthalic acid, but also be a chain-type polybasic carboxylic acid. The chain-type polybasic carboxylic acid is an organic acid selected from the group consisting of oxalic acid and acids having at least two hydrogen atoms of chain-type hydrocarbons substituted by carboxyl groups. Specifically, it may, for example, be malonic acid, succinic acid, adipic acid, maleic acid or oxalic acid. This polybasic carboxylic acid may partially or entirely be in the form of an anhydride. Further, so long as it is a substance showing acidity when formed into an aqueous solution, it may further contain other substituents such as a hydroxyl group and an amino group, like citric acid or aspartic acid. The chain-type polybasic carboxylic acid preferably has a carbon number of at most 10 inclusive of the carbon atoms of the carboxyl groups. If the carbon number exceeds 10, the solubility in various solvents tends to be low, whereby handling will be difficult, such being undesirable.

Among the above-mentioned chain-type polybasic carboxylic acids, succinic acid, adipic acid, maleic acid and malonic acid are preferred, since they are highly effective for preventing a color change and they have excellent printing properties when employed for printing by an ink jet printer. Particularly preferred is succinic acid.

The organic acid with the first acid dissociation exponent of at most 5, which has an aromatic nucleus or at least two carboxyl groups, may be present in the form of a salt. As such a salt, preferred is a salt, of which an aqueous solution is acidic. As such a salt, a salt having the hydrogen atoms of the carboxyl groups of the dicarboxylic acid partially substituted by cations, may be mentioned. As such cations, alkali metal ions or ammonium ions are preferred. Hereinafter, the organic acid with the first acid dissociation exponent of at most 5, which has an aromatic nucleus or at least two carboxyl groups, will be referred to simply as the organic acid.

As a method for applying the above organic acid to the colorant absorbing layer, a method is preferably employed wherein a solution having the above organic acid dissolved in a suitable solvent is applied to the preliminarily formed colorant absorbing layer by a dipping method or by a spraying method. Otherwise, it is possible to employ a method wherein the above organic acid is mixed to the raw material for forming the colorant absorbing layer. In the method of applying the solution to the colorant absorbing layer, the solvent may suitably be selected depending upon the solubility of the organic acid. When the above organic acid is used in the form of a salt, there is a merit that water can be used as the solvent.

The content of the above organic acid is preferably from 0.05 to 7.5 wt %, based on the weight of the colorant absorbing layer. If the content of the above organic acid is less than 0.05 wt %, no adequate effects of the present invention tend to be obtained, whereby a color change of the recording sheet is likely to result, such being undesirable. If the content of the above organic acid exceeds 7.5 wt %, there will be no further increase in the effects for suppressing a color change. Not only that the absorptivity of the porous layer is likely to be impaired. More preferably, the content of the organic acid is from 0.5 to 5.5 wt %.

In the present invention, the colorant absorbing layer is a porous layer capable of absorbing and fixing colorants at the time of recording. The colorants include dyes and pigments. It is particularly preferred to employ a dye for recording, since it is thereby possible to obtain particularly high image quality. If the thickness of the colorant absorbing layer is too thin, the colorant can not adequately be supported, and only a printed record with a low color density will be obtained, such being undesirable. On the other hand, if it is too thick, there will be a drawback such that the strength of the colorant absorbing layer will decrease, or the transparency will decrease to impair the transparency or the quality of the printed matter, such being undesirable. A preferred thickness of the colorant absorbing layer is from 1 to 50 μm.

The colorant absorbing layer is required to be a porous inorganic oxide. Specifically, it preferably has a structure having inorganic oxide particles bonded preferably by a binder. The material of such inorganic oxide particles is preferably silica or alumina, or a hydrate thereof. Particularly preferred is a pseudoboehmite porous layer, since it has good absorptivity and at the same time is capable of selectively adsorbing dyes, whereby it is possible to obtain clear records with high color densities by means of various types of recording systems. Here, the pseudoboehmite is an alumina hydrate of the compositional formula $Al_2O_3 \cdot xH_2O$ (wherein x=1 to 1.5) and an agglomerate having a porous structure.

When the inorganic oxide is pseudoboehmite, the above organic acid is preferably incorporated in an amount within a range of from 0.2 to 30 mmol, more preferably from 1 to 20 mmol, per mol of Al atoms.

The pseudoboehmite porous layer preferably has a porous structure comprising pores with radii of from 1 to 10 nm and having a pore volume of from 0.3 to 1.0 cc/g, since such a layer has adequate absorptivity and transparency. Here, if the substrate is transparent, the recording sheet will also be transparent. If the substrate is opaque, it is possible to impart the necessary physical properties without impairing the quality of the substrate. In addition to such physical properties, it is further preferred that the average pore radius of the pseudoboehmite porous layer is from 3 to 7 nm. Here, the pore size distribution is measured by a nitrogen absorption/desorption method.

To prepare a pseudoboehmite porous layer having such a porous structure, it is preferred to coat on a substrate with a boehmite sol. As the boehmite sol, it is preferred to use a boehmite sol produced by hydrolysis of an aluminum alkoxide. As the coating method, it is preferred to employ a method which comprises preparing a slurry preferably by adding a binder to the boehmite sol, coating the slurry on the substrate by means of a roll coater, an air knife coater, a blade coater, a rod coater, a bar coater or a comma coater, followed by drying.

As the binder, an organic substance such as starch or its modified product, polyvinyl alcohol or its modified product, SBR latex, NBR latex, hydroxy cellulose, or polyvinylpyrrolidone, may be employed. The binder is used preferably in an amount of from 5 to 50 wt %, based on the inorganic oxide, since if the amount is small, the strength of the colorant absorbing layer tends to be inadequate, and on the other hand, if the amount is too large, the amount of ink to be absorbed or the amount of the colorant to be supported tends to be low.

In the present invention, various types of materials may be used for the substrate. For example, a plastic material, e.g. a polyester such as polyethylene terephthalate, polycarbonate, or a fluorine resin such as ETFE, or paper may suitably be employed. To such a substrate, corona discharge treatment or undercoating may be applied for the purpose of improving the adhesive strength of the colorant absorbing layer.

The function of the above organic acid in the present invention is not clearly understood. However, it is believed that the organic acid is adsorbed in the colorant absorbing layer and somehow suppresses the color development or adsorption of a component such as a plasticizer to a plastic which causes a color development.

Now, the present invention will be described in further detail with reference to Examples. However, it should be understood that the present invention is by no means restricted by such Examples.

EXAMPLE 1

Into a glass reactor having a capacity of 2,000 cc, 540 g of water and 676 g of isopropyl alcohol were charged and heated by a mantle heater so that the liquid temperature became 75° C. While stirring, 306 g of aluminum isopropoxide was added thereto, and hydrolysis was carried out for 5 hours while maintaining the liquid temperature at a level of from 75° to 78° C. Then, the temperature was raised to 95° C., and 9 g of acetic acid was added thereto, and the mixture was maintained for 48 hours at a temperature of from 75° to 78° C. for peptization. Further, this liquid mixture was concentrated to 900 g to obtain a white sol. The dried product of this sol was pseudoboehmite. To 5 parts by weight of this alumina sol, 1 part by weight of polyvinyl alcohol was added, and water was further added thereto to obtain a slurry with a solid content of about 10%. This slurry was coated on a substrate made of polyethylene terephthalate (thickness: 100 μm) having corona discharge treatment applied thereto, by means of a bar coater, so that the layer thickness upon drying would be 30 μm, followed by drying to form a porous layer (a colorant absorbing layer) of pseudoboehmite. The pore radius of this porous layer was 5.5 nm.

The coated side of the sheet thus obtained was dipped in an ethanol solution of phthalic acid having a concentration as identified in Table 1, so that the solution was uniformly coated. The coated sheet was vertically hung and dried in air, and then heated in a drum dryer at 140° C. for 4 minutes.

To quantify the amount of phthalic acid in the colorant absorbing layer of the recording sheet thus obtained, a part of the recording sheet was cut out and immersed in an aqueous solution of hydrochloric acid for 12 hours, and then the solution was titrated with a solution of sodium hydroxide.

To evaluate the ability of suppressing color change, polyvinyl chloride films of the same size were overlaid on the coated sides of the recording sheet and a comparative recording sheet having no phthalic acid treatment applied thereto. The specimens were left in a room for 14 days, whereupon the presence or absence of yellowing at the edges of the sheets was visually checked. The results are shown in Table 1.

In Table 1, the unit for the phthalic acid concentration in the treating solution is M (mol/l), and the unit for the amount of phthalic acid in the sheet is mmol per mol of Al atoms in the pseudoboehmite. In the column for "Yellowing of the edges" in Table 1, "Positive" means that yellowing was clearly observed by visual observation of only one sheet, "Slight" means yellowing was observed by visual observation of three sheets piled one on another, and "Negative" means that no yellowing was observed even when three sheets were piled one on another.

TABLE 1

| Phthalic acid concentration in the treating solution | Amount of phthalic acid in the sheet | Yellowing of the edge |
|---|---|---|
| 0.01 | 0.3 | Slight |
| 0.02 | 0.6 | Slight |
| 0.05 | 1.5 | Negative |
| 0.10 | 3.0 | Negative |
| 0.20 | 6.2 | Negative |
| 0.30 | 9.6 | Negative |
| 0.50 | 15.1 | Negative |
| 0.70 | 22.0 | Negative |
| Not treated | 0 | Positive |

EXAMPLE 2

The coated side of the sheet obtained in Example 1 was dipped in an ethanol solution or an aqueous solution containing 0.2M of an organic acid as identified in Table 2, so that the solution was uniformly coated. The coated sheet was vertically hung and dried in air, and then heated in a drum dryer at 140° C. for 4 minutes. Polyvinyl chloride films of the same size were overlaid on the coated sides of the respective recording sheets. The specimens were left in a room for 14 days, whereupon the presence or absence of yellowing at the edges of the sheets was visually checked. With respect to all recording sheets treated with the compounds in Table 2, no yellowing was observed even when at least three sheets were piled one on another.

TABLE 2

| Organic acid in the treating solution | Solvent |
|---|---|
| Phthalic anhydride | Ethanol |
| Isophthalic acid | Ethanol |
| Terephthalic acid | Ethanol |
| Benzoic acid | Ethanol |
| Salicylic acid | Ethanol |
| Phenylacetic acid | Ethanol |
| Ammonium hydrogen phthalate | Water |
| Ammonium phthalate | Water |
| Pottasium hydrogen phthalate | Water |
| Benzenesulfonic acid | Water |

EXAMPLE 3

With respect to a sheet of coated paper obtained by coating porous silica on a paper substrate, an ethanol solution of phthalic acid with a concentration of 0.3M was impregnated from the coated side in the same manner as in Example 1, so that the solution was uniformly coated. The coated paper was vertically hung and dried in air, and then heated in a drum dryer at 140° C. for 4 minutes.

Polyvinyl chloride films of the same size were overlaid on the coated sides of the recording sheet thus obtained and a comparative recording sheet having no treatment applied. The specimens were left at room temperature for 14 days. Yellowing was observed on the edge of the non-treated sheet. Whereas, no such yellowing was observed with the treated sheets.

EXAMPLE 4

The colorant absorbing layer side of the recording sheet obtained in Example 1 was dipped in an ethanol solution or an aqueous solution of a chain-type polybasic carboxylic acid or its salt as identified in Table 3 at a concentration of 0.2 mol/l, so that the solution was uniformly coated. The coated sheet was vertically hung and dried in air, and then heated in a drum dryer at 140° C. for 4 minutes.

Polyvinyl chloride films of the same size were overlaid on the coated sides of the respective recording sheets thus obtained. The specimens were left in a room for 14 days. With the respective recording sheets, no yellowing was observed.

TABLE 3

| Organic acid in the treating solution | Solvent |
|---|---|
| Succinic acid | Ethanol |
| Succinic anhydride | Ethanol |
| Adipic acid | Ethanol |
| Monoammonium adipate | Ethanol |
| Maleic acid | Ethanol |
| Monoammonium maleate | Water |
| Malonic acid | Water |
| Oxalic acid | Water |

EXAMPLE 5

With respect to a sheet of coated paper obtained by coating porous silica on a paper substrate, a 0.2 mol/l solution of the chain-type polybasic carboxylic acid as identified in Table 1 was impregnated from the coated side as shown in Example 4, so that the solution was uniformly coated. This coated paper was vertically hung and dried in air, and then heated in a drum dryer at 140° C. for 4 minutes.

Polyvinyl chloride films of the same size were overlaid on the coated sides of the respective recording sheet thus obtained and a comparative recording sheet having no treatment applied. The specimens were left in a room for 14 days. As for the non-treated sheet, yellowing was observed on the edge of the sheet. Whereas, with the respective treated sheets, no such yellowing was observed.

The recording sheet of the present invention is excellent in the ink absorption and in the fixing of a colorant. Moreover, it undergoes no color change even when stored for a long period of time. The recording sheet of the present invention is useful for various recording systems and particularly effective as a recording medium for an ink jet printer.

We claim:

1. A recording sheet comprising a substrate and a colorant absorbing layer which has a structure having porous inorganic oxide particles bonded by a binder which is present in an amount of from 5 to 50 wt. % based on the porous inorganic oxide, formed on the substrate, wherein said colorant absorbing layer contains an organic acid with the first acid dissociation exponent of at most 5, which has an aromatic nucleus or at least two carboxyl groups.

2. The recording sheet according to claim 1, wherein the organic acid with the first acid dissociation exponent of at most 5, which has an aromatic nucleus or at least two carboxyl groups, is at least one member selected from the group consisting of phthalic acid, isophthalic acid, terephthalic acid, benzoic acid, phenylacetic acid, salicylic acid, benzenesulfonic acid, succinic acid, adipic acid, maleic acid and malonic acid.

3. The recording sheet according to claim 1, wherein the organic acid with the first acid dissociation exponent of at most 5, which has an aromatic nucleus or at least two carboxyl groups, is present in the form of its salt, of which an aqueous solution is acidic.

4. The recording sheet according to claim 1, wherein the organic acid with the first acid dissociation exponent of at most 5, which has an aromatic nucleus or at least two carboxyl groups, is in an amount of from 0.05 to 7.5 wt %, based on the weight of the colorant absorbing layer.

5. The recording sheet according to claim 1, wherein the colorant absorbing layer contains pseudoboehmite.

6. The recording sheet according to claim 5, wherein the content of the organic acid with the first acid dissociation exponent of at most 5, which has an aromatic nucleus or at least two carboxyl groups, is from 0.2 to 30 mmol per mol of Al atoms in the pseudoboehmite of the colorant absorbing layer.

7. The recording sheet according to claim 1, wherein the organic acid with the first acid dissociation exponent of at most 5 is selected from the group consisting of malonic acid, succinic acid, adipic acid, maleic acid and oxalic acid.

8. The recording sheet according to claim 5, wherein said pseudoboehmite comprises pores with radii of from 1 to 10 nm and a pore volume of from 0.3 to 1.0 cc/g.

9. The recording sheet according to claim 1, wherein the colorant absorbing layer contains silica.

10. The recording sheet according to claim 1, which is a recording medium for an ink jet printer.

11. The recording sheet according to claim 1, wherein the organic acid with the first acid dissociation exponent of at most 5 is an aliphatic dibasic carboxylic acid having 6–10 carbon atoms.

12. The recording sheet according to claim 1, wherein the organic acid with the first acid dissociation exponent of at most 5 is selected from the group consisting of phthalic acid, isophthalic acid, terephthalic acid, benzoic acid, phenylacetic acid, salicylic acid and benzenesulfonic acid.

13. The recording sheet according to claim 1, wherein the organic acid with the first acid dissociation exponent of at most 5 is a polybasic carboxylic acid having a hydroxyl or amino substituent.

14. The recording sheet according to claim 1, wherein the organic acid with the first acid dissociation exponent of at most 5 is selected from the group consisting of malonic acid, succinic acid, adipic acid, maleic acid and oxalic acid.

15. A record comprising a substrate, a colorant absorbing layer which has a structure having porous inorganic oxide particles bonded by a binder which is present in an amount of from 5 to 50 wt. % percent, based on said porous inorganic oxide, formed on the substrate and containing an organic acid with the first acid dissociation exponent of at most 5, which has an aromatic nucleus or at least two carboxyl groups, and a colorant supported in the colorant absorbing layer.

16. The record according to claim 15, wherein the colorant absorbing layer contains pseudoboehmite.

* * * * *